United States Patent [19]

Oda

[11] Patent Number: 5,005,260

[45] Date of Patent: Apr. 9, 1991

[54] STATIONARY FLAT, TOP BAR AND CARDING ENGINE

[75] Inventor: Takumi Oda, Kobe, Japan

[73] Assignee: Kanai Juyo Kogyo Company, Limited, Hyogo, Japan

[21] Appl. No.: 442,986

[22] Filed: Nov. 28, 1989

[30] Foreign Application Priority Data

Nov. 30, 1988 [JP] Japan ..... 63-303180

[51] Int. Cl.[5] ..... D01G 15/28

[52] U.S. Cl. ..... 19/104; 19/113

[58] Field of Search ..... 19/98, 99, 104, 110, 19/113

[56] References Cited

U.S. PATENT DOCUMENTS

| | | | |
|---|---|---|---|
| 11,448 | 8/1854 | Woodman | 19/110 |
| 1,550,444 | 8/1925 | Marsh | 19/98 |
| 3,858,276 | 1/1975 | Hollingsworth | 19/98 |
| 3,995,351 | 12/1976 | Otani | 19/102 |
| 4,241,475 | 12/1980 | Miller | 19/98 |
| 4,286,357 | 9/1981 | Harrison, Sr. | 19/98 |
| 4,593,437 | 6/1986 | Graf et al. | 19/113 |
| 4,757,575 | 7/1988 | Varga | 19/103 |
| 4,947,522 | 8/1990 | Staehli | 19/104 |

FOREIGN PATENT DOCUMENTS

| | | | |
|---|---|---|---|
| 745707 | 12/1943 | Fed. Rep. of Germany | 19/113 |
| 905827 | 1/1954 | Fed. Rep. of Germany | 19/98 |
| 231868 | 4/1944 | Switzerland | 19/98 |
| 124850 | 6/1959 | U.S.S.R. | 19/98 |
| 1829 | of 1915 | United Kingdom | 19/98 |
| 400971 | 11/1933 | United Kingdom | 19/113 |

*Primary Examiner*—Werner H. Schroeder
*Assistant Examiner*—Michael A. Neas
*Attorney, Agent, or Firm*—Wenderoth, Lind & Ponack

[57] ABSTRACT

In order to make gauge regulation simple and to make it possible to exchange or grind the card clothing in each individual top bar, the present invention provides a stationary flat unit which is composed of a stationary flat having a plurality of top bars adjustably fitted between two sash-like plates for adjustment in up and down directions, and arms fixed to both side surfaces of the statinary flat. This stationary flat has the effect of reducing the time required for fitting, reducing the frequency of maintenance and prolonging the service life of the card clothing.

6 Claims, 8 Drawing Sheets

STATIONARY FLAT, TOP BAR AND CARDING ENGINE

BACKGROUND OF THE INVENTION

1. Field of the Invention

This invention relates to a stationary flat to be fitted onto the peripheral surface of a cylinder of a carding engine.

2. Description of the Prior Art

Conventionally, as shown in FIG. 10, a plurality of stationary flats 33 are fixed on a cylinder 29 of a carding engine 28 between a top 30 and a doffer 31 or between a top 30 and a taker-in 32 (Japanese Patent Application Laid Open Gazette No. 61-1604727). However, since each of such stationary flats is fastened to the cylinder of a carding engine by bolts, it has been very difficult to regulate accurately the gauge of each of the plural stationary flats. Also, in the case where the card clothing of each of such plural stationary flats has worn due to carding action, it has been impossible to grind the card wires. Moreover, in the case where the stationary flats are cleaned and the card wires of a drum are ground and cleaned, the stationary flats must be detached one by one and when they are refixed to the carding engine, it is necessary to reregulate the gauge of each stationary flat. Thus, the trouble has been that complicated operations and a large number of steps are required for grinding, cleaning and refixing.

As a means of solving the above problem of the prior art, a stationary flat proper (a covering plate with metallic card clothing mounted on the inner side thereof) swingably mounted at the proper place of the peripheral surface of a cylinder on an arm has been suggested (Japanese Patent Application Laid Open Gazette No. 62-41322). However, since the above-mentioned stationary flat is a covering plate with a card clothing mounted on the inner side thereof, when the card clothing is partially damaged, it must be replaced in its entirety. Thus, labor and expense are required for replacing and it is impossible to grind card wires while they are on the carding engine.

SUMMARY OF THE INVENTION

An object of the present invention is to make the gauge regulation during the fitting of stationary flats simple and uniform and to substantially reduce the time required for fitting stationary flats.

Another object of the present invention is to make it possible to exchange only a damaged top bar and thereby reduce the frequency of maintenance.

In order to attain the above objects, the present invention provides a stationary flat unit which is constituted in the following way. A stationary flat is formed by two base members, each having the required radius of curvature and plural stud bolts at its upper surface, and a plurality of top bars, each having brackets at both ends thereof and card clothing on the under side thereof, in which the stud bolts of the base member have the brackets of the top bars fitted thereon and the top bars are fixed adjustably in the up and down direction by nuts. A stationary flat unit is constituted by fixing arms on both side faces of the above stationary flat.

By fitting the stationary flat unit of the above structure swingably through the medium of the arm so that the surface of its card clothing can approach the peripheral surface of the cylinder, a carding engine equipped with stationary flats of the opening and closing type is provided.

In the stationary flats of the above structure and a carding engine provided with such stationary flats, stationary flats are arranged on the peripheral surface of the carding engine and are fixed by bolts, and the gauge between the card clothing of the cylinder and the top bar is regulated properly by a nut which mounts the top bar to a base member and finally said nut is tightened to fasten the top bar to the base member. In the case where cotton dust and other foreign matter adhere to the surfaces of card clothings of the stationary flats and the drum due to carding action are to be cleaned, a bolt by which a stationary flat is mounted is removed, the stationary flat is freed from the peripheral edge of the cylinder by swinging the arm, the surface of the card clothing is cleaned, the stationary flats are rearranged on the peripheral surface of the cylinder and are again fixed by bolts. Thus, cleaning and fitting operations are completed. In the case where the card clothing of the stationary flats is worn due to carding action, it is possible to remove the top bar and grind the card wires by a grinding machine.

Since the gauge of the stationary flats according to the present invention is adjustable at each top bar, gauge regulating steps during fixing of stationary flats to the carding engine can be carried out easily and uniformly, resulting in a large reduction of time required for fitting. Also, only those top bars which are damaged need be exchanged and therefore exchange of top bars is simple and maintenance frequency can be reduced.

Moreover, as guide parts for the grinding card clothing are provided at both ends of the top bar proper, when a card clothing is worn it is possible to grind the card clothing by a grinder on the basis of the guide part and therefore it is not necessary to replace the card clothing. Thus, the usable life of the card clothing is prolonged to a large degree and an excellent fiber loosening effect can be maintained for a long period of time.

Since the carding engine fitted with stationary flats according to the present invention has openable and closable stationary flats, foreign matter such as cotton dust adhered between the teeth of the stationary flat or between the flat and the drum can be removed easily. Moreover, gauge regulation is not necessary when refitting stationary flats after cleaning. Thus, the time required for cleaning and regulation is greatly reduced and productivity is improved. By providing a blowoff preventive member on the stationary flat, blowoff of air currents is eliminated, parallelism of the fiber is improved and the yield rate is also improved.

BRIEF DESCRIPTION OF THE DRAWINGS

The nature and advantages of the present invention will be understood more clearly from the following description made with reference to the accompanying drawings, in which:

FIG. 2c is a sectional end elevation view of the stationary flat of FIG. 2a, taken along line B—B in FIG. 2a;

FIG. 4b is an end view of the top bar shown in FIG. 4a;

FIG. 5b is a sectional end view of the stationary flat, taken along line C—C in FIG. 5a;

FIG. 6b is a bottom view of the stationary flat shown in FIG. 6a;

DETAILED DESCRIPTION OF THE INVENTION

First Embodiment

Figure 1A:
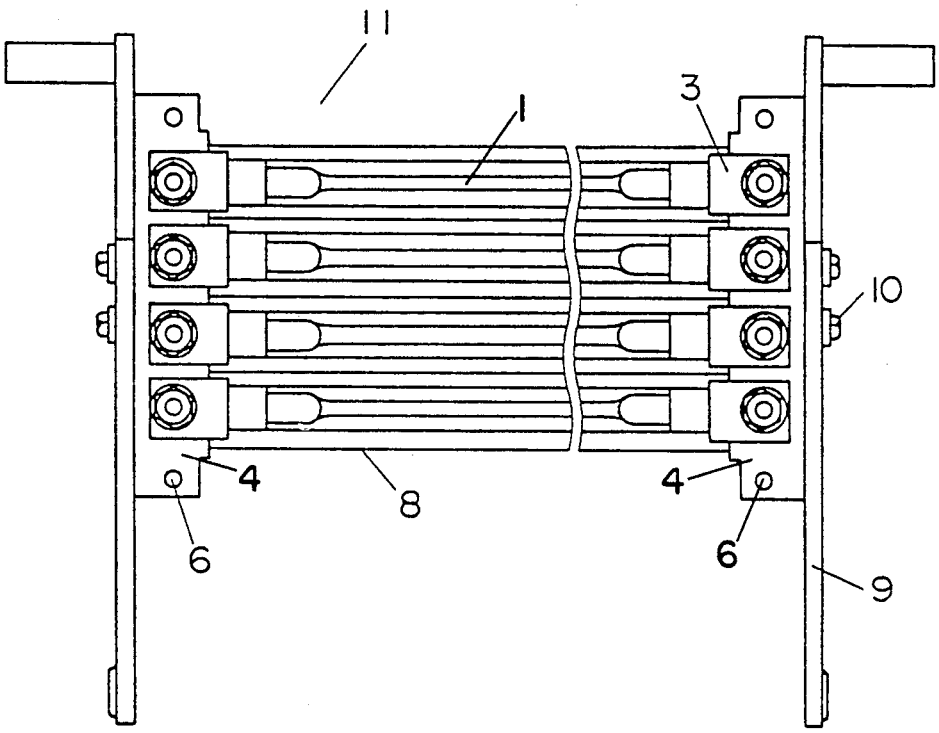
FIG. 1*a* is a plan view of the stationary flat.
Figure 1B:
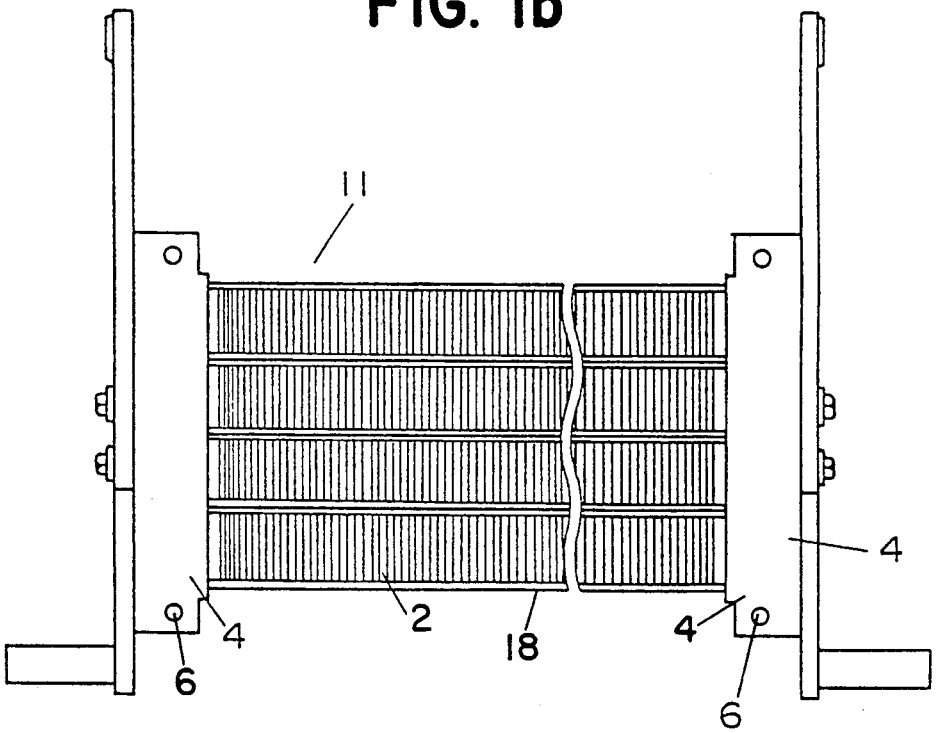
FIG. 1*b* is a bottom view of the stationary flat shown in FIG. 1*a*.

As shown in FIGs. 1a and 1b and FIGS. 2a, 2b and 2c, a card clothing 2 is removably mounted on the under surface of a top bar 1 and brackets 3 of inverted-L shape are provided at both ends of the top bar body 17. A bolt hole passes vertically through the upper part of the bracket 3. A base member 4 is a sash-like plate having a radius of curvature which is substantially equal to that of a front concentric bend of the carding engine. A plurality of stud bolts are detachably mounted on the upper surface of the base member 4. Bolt holes 6 are made at both ends of the base member 4. The stationary flat 8 is formed by placing a plurality of top bars 1 in parallel and extending between two base members 4, the holes of the brackets 3 of said top bars being freely movable on upstanding stud bolts 5 on said base members, and adjusting nuts 7 are threaded on the stud bolts 5 above and below the brackets 3, thus making it possible to adjust the vertical position of the top bars 1 by turning the adjusting nuts. Arms 9 are fixed to both sides of a stationary flat 8 by bolts 10 to form a stationary flat unit 11.

In the above embodiment, the base member 4 is formed of two members but may be formed of only one member having an opening for fitting the top bars into the central part thereof. By this arrangement, rigidity of the base member 4 is improved and warp is lessened, with the result that stationary flats of more accuracy of gauge regulation can be obtained.

Figure 2A:
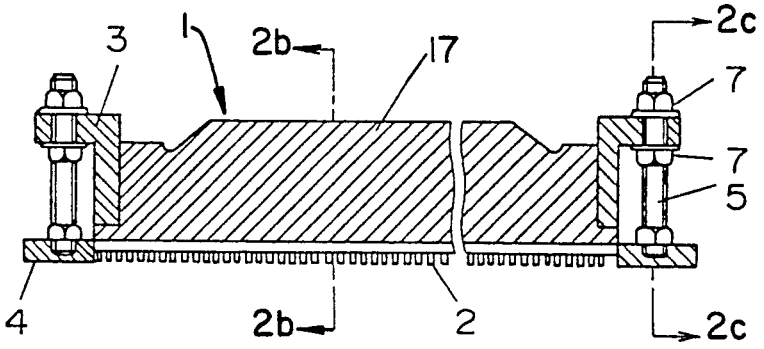
FIG. 2*a* is a cross section of the stationary flat shown in FIG. 1.
Figure 2B:
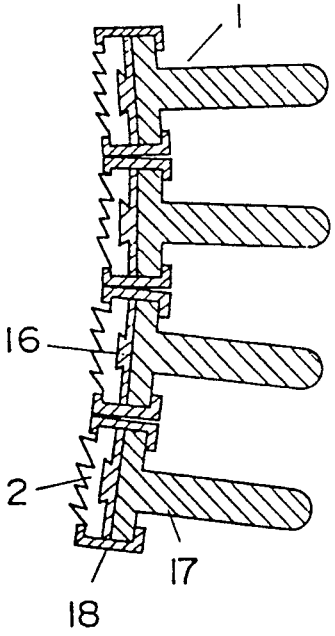
FIG. 2*b* is a sectional end elevation view of the stationary flat of FIG. 2*a*, taken along line A—A in FIG. 2*a*.
Figure 2C:
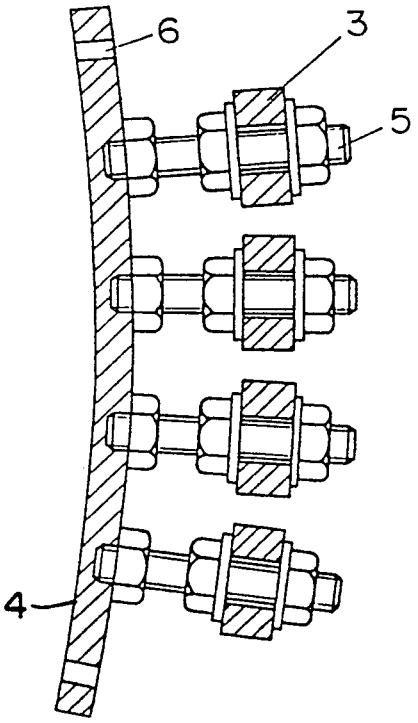
Figure 3:
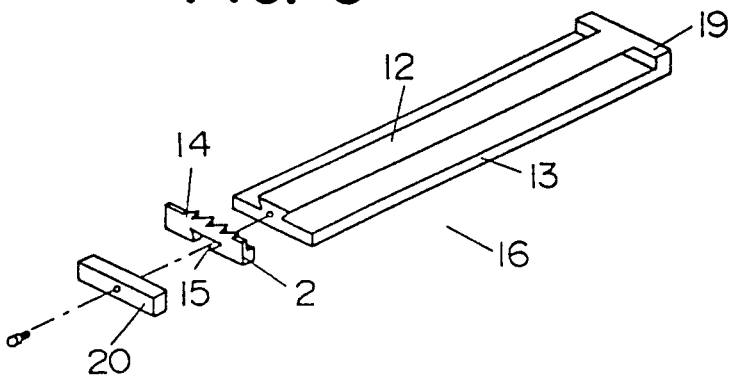
FIG. 3 is an exploded view of a card clothing body partly disassembled.

As shown in FIGS. 2b and 3, the top bar 1 is constituted as follows. A metallic card clothing 2 having a sawtooth part 14 on an outer surface and a dovetail groove 15 in the inner surface thereof is fitted on a liner 13 having a dovetail projection 12 extending in a lengthwise direction of its upper surface. A plurality of such metallic card clothings 2 are arranged in a row to form a card clothing body 16. Such a card clothing body 16 is mounted on the under surface of a top bar body 17 and fixed integrally thereto by side clips 18. Reference numeral 19 designates a stopper at one end of liner 13 for preventing the metallic card clothings 2 from slipping off, and reference numeral 20 designates an end stopping plate attachable to the other end of liner 13 for holding the metallic card clothings 2 on the liner.

In the top bar 1 described above, metallic card clothing is used, but ordinary card clothing may be used as in the case of the conventional top card clothing. As to the method of mounting the metallic card clothing, other means than in the above embodiment can be adopted. The number of top bars 1 is shown as four in this embodiment, but any number of top bars, preferably 2-6, can be adopted.

Second Embodiment

Figure 4A:
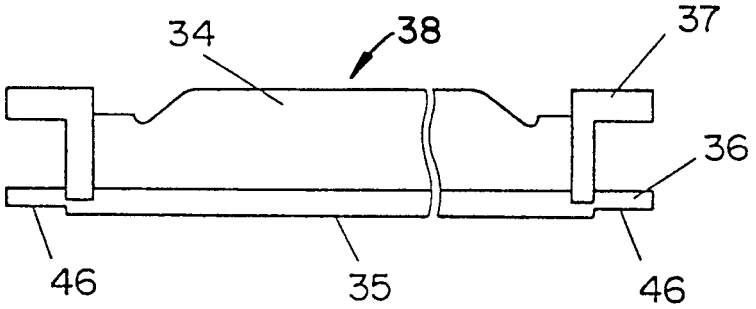
FIG. 4a is a front view of the top bar of a stationary flat according to a second embodiment of the invention.
Figure 4B:
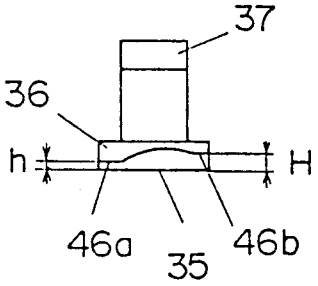

As shown in FIGS. 4a and 4b, a top bar body 34 has a card clothing adhering surface 35 at the under side thereof, guide parts 36 for use in grinding the card clothing at both ends thereof and brackets 37 of inverted-L shape at the upper part of both ends. The top bar 38 is completed by detachably adhering card clothing 2 on the car clothing adhering surface 35 of said top bar body 34 as indicated in FIG. 5.

Figure 5A:
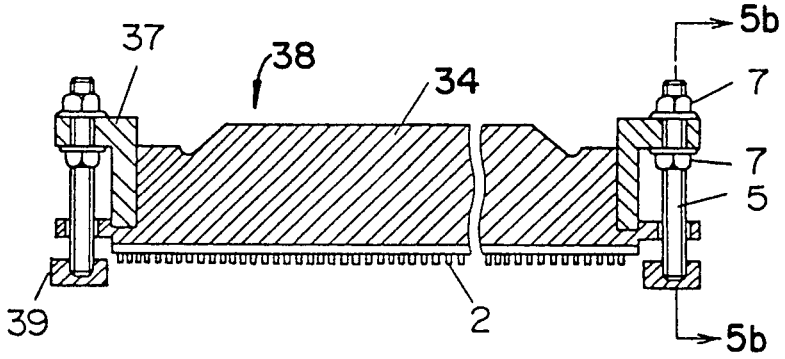
FIG. 5a is a cross section of the stationary flat according to a second embodiment of the invention.
Figure 5B:
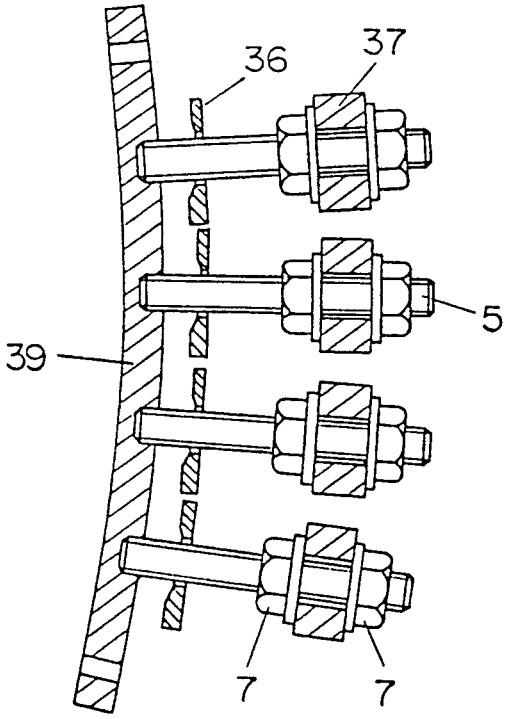
Figure 6A:
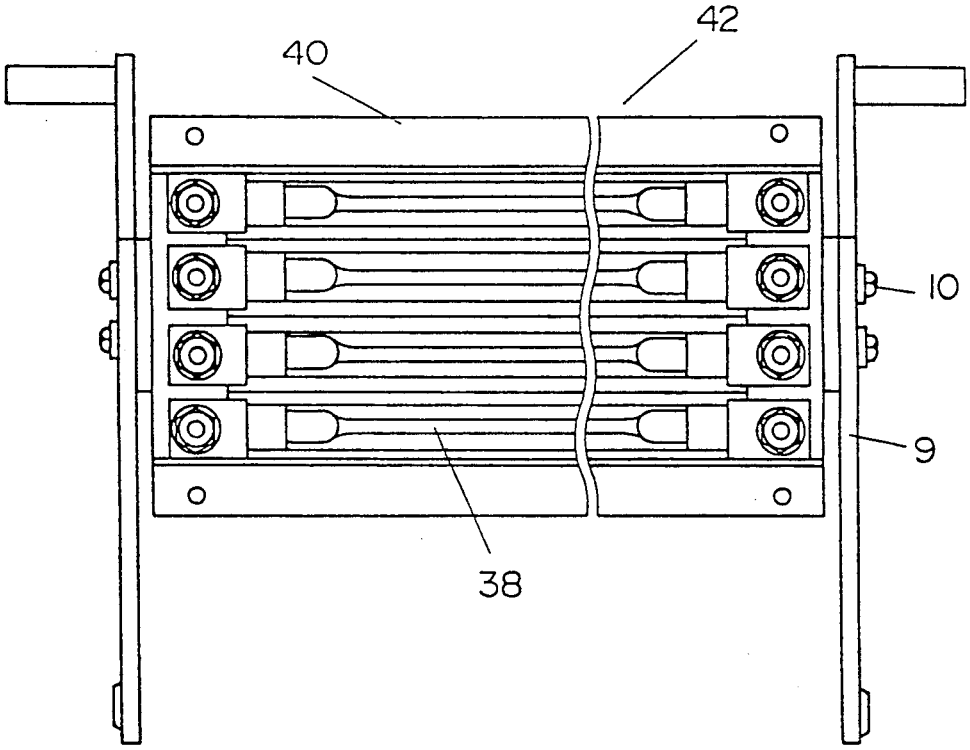
FIG. 6a is a plan view of the stationary flat according to a second embodiment of the invention.
Figure 6B:
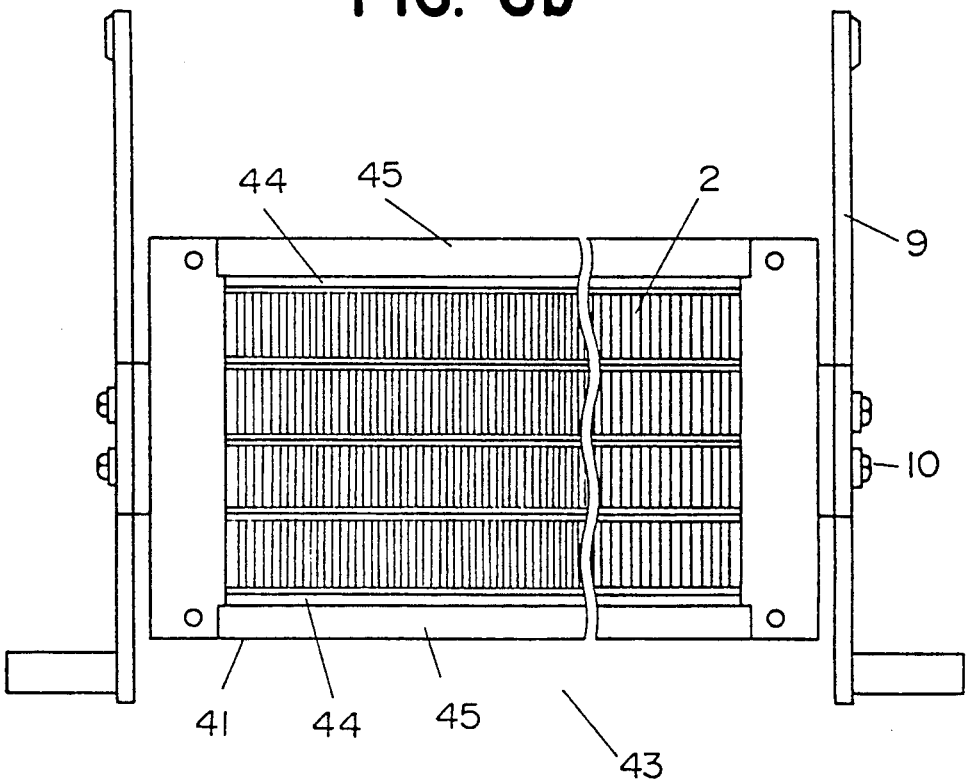

As shown in FIGS. 5a and 5b, a base member 39 is in the form of a sash-like plate having a radius of curvature which is substantially equal to that of a front concentric bend of the carding engine. A plurality of stud bolts 5 are mounted on the upper surface of the base member 39. Both ends of the base member 39 are connected by a fixing member 40 and a frame body 41 having an opening for accommodating the top bars 38 at the central part thereof.

The top bar 38 and the frame body 41 constituted as above are formed into a stationary flat 42 in the following way. The stud bolts 5 on the base member 39 are put through holes in the brackets 37 and the guide parts 36 and nuts 7 are threaded onto the stud bolts above and below the brackets 37 so that the position of the top bars 38 can be adjusted in the up and down direction and then fixed by tightening the nuts 7. The end surfaces of such stationary flat 42 are fixed to the arms 9 by bolts 10 and thus a stationary flat unit 43 is constituted.

In the stationary flat unit 43, blowoff preventive members 44 are fixed to the under surface of the fixing members 40 so that there is no gap between the top bars 38 and a front top sheet or a front bottom sheet of the carding engine cylinder, namely, the front top sheet or the front bottom sheet will tightly contact with the side surface of the top bars 38. Also, a sheet member 45 of felt, rubber or the like is fixed to the under surface of the stationary members 40 so that there is no gap between the stationary member 40 and the front top bar or the rear top bar.

Since the blowoff preventive member 44 prevents formation of a gap between the stationary member 40 and the top bar 38 as described above, it is possible to prevent an air current produced as a result of rotation of the cylinder from blowing out through such a gap.

As shown in FIG. 4b, the top bar body 34 should preferably be formed in such a fashion that a sliding surface 46 formed at the under side of the guide part 36 is divided into a sliding surface 46a on the toe side and a sliding surface 46b on the heel side, and the height h between the sliding surface 46a on the toe side and the card clothing surface 35 is 1/32", and the height H between the sliding surface 46b on the toe side and the card clothing surface 35 is 1/32"+25/1000. However, it is possible to make the height h 0.7mm ~0 9mm and the height H 1.3mm~1.9mm.

In the above construction, if the card clothing 2 on the top bar body 38 is worn, it is easy to take the top bar 38 off the stationary flat 43 and grind it by a top card clothing grinding machine. Therefore, it is not necessary to replace the card clothing 2, and the fiber loosening effect can be maintained for long periods of time.

Third Embodiment

Figure 7:
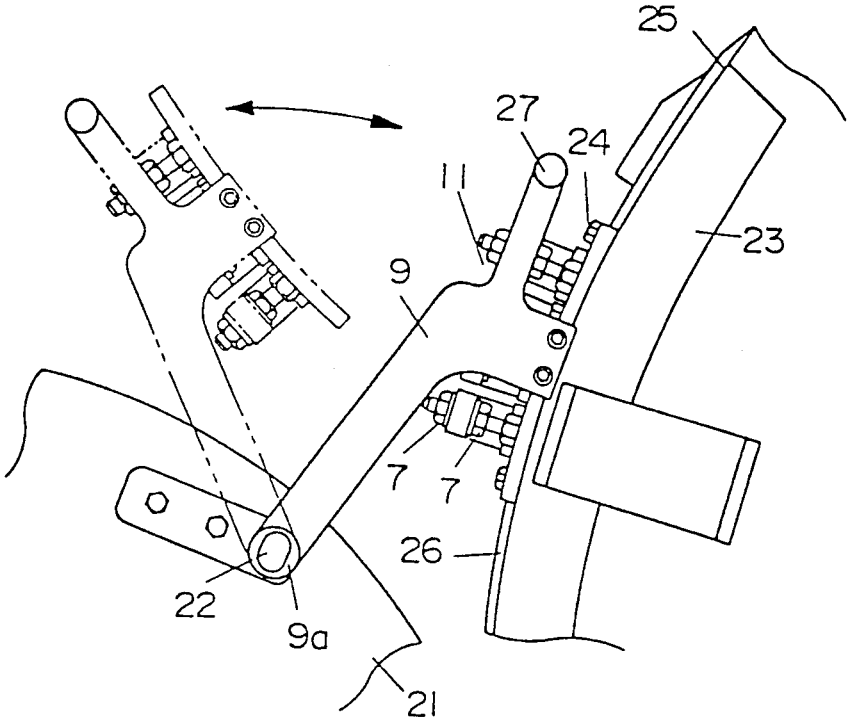
FIG. 7 is an end elevation view showing a main part of an embodiment of the carding engine according to a third embodiment of the invention.
Figure 8:
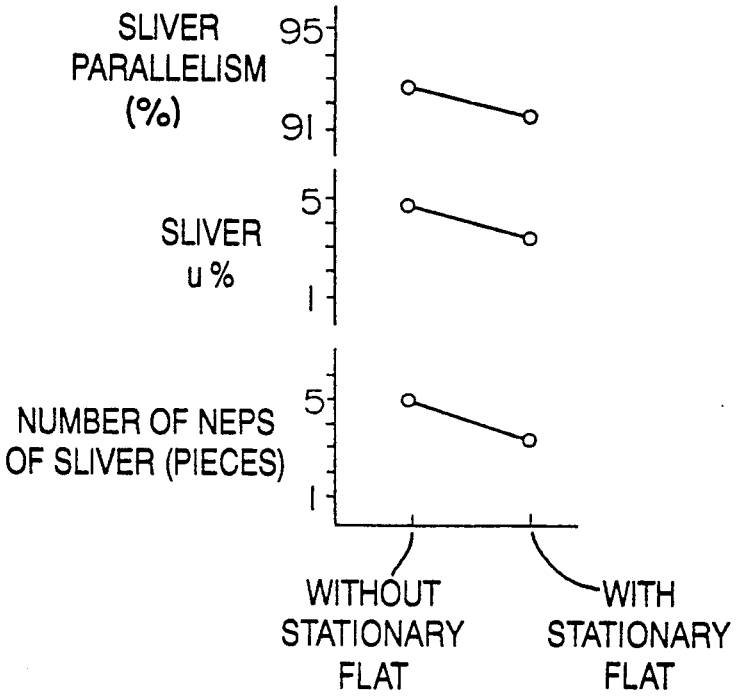
FIGS. 8 and 9 are graphs showing the spinning data for a carding engine using and not using stationary flats, respectively, according to the present invention.
Figure 10:
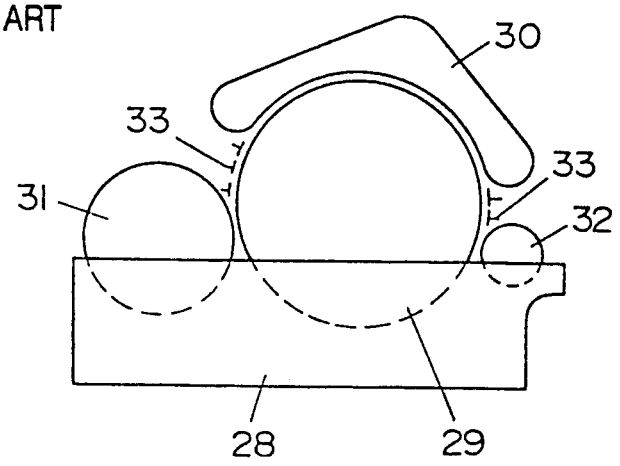
FIG. 10 PRIOR ART
FIG. 10 is a schematic drawing showing a carding engine provided with conventional stationary flats.

As shown in FIG. 7, a stationary flat unit 11 formed in the same fashion as in the first embodiment is fitted swingably to a doffer bend 21 on both side surfaces of the carding engine by swingably mounting an end portion 9*a* of the arm 9 on both side surfaces of the stationary flat unit 11 to the doffer bend by a bolt 22 so that the card clothing surface of the stationary flat unit 11 can be carried out easily.

Then the stationary flat 11 is fixed to a front concentric bend 23 by using bolts 24. Reference numeral 25 designates a front top sheet and reference numeral 26 designates a front bottom sheet.

As mentioned above, in the carding engine according to the present invention, a stationary flat or flats are arranged on the peripheral surface of the cylinder between the top and the doffer, but they can be arranged on the peripheral surface of the cylinder between the top and the taker-in.

In adjusting the gauge of the top bar, adjustment nuts 7 provided for each top bar 1 of the stationary flat 11 are loosened, the gauge between the card clothing surface of the top bar 1 and the card clothing surface of the drum is adjusted, and then the nuts 7 are tightened to fix the top bar 7 in position. It is preferable to carry out this gauge adjusting operation beginning with the lowermost top bar.

In the case where the card clothing surfaces of the stationary flat and the drum are to be cleaned, bolts 24 securing the four corners of the stationary flat are removed, the stationary flat is swung in the arrow direction (in FIG. 7) by a handle 27 of the arm 9, around the bolts 22 as an axis, and after cleaning the stationary flat is closed by the handle 27 and is secured by the bolts 24. In this case, since adjustment of the gauge has been carried out beforehand, gauge adjustment is not necessary and therefore cleaning operations can be simply done.

Spinning tests were carried out, with the stationary flats according to the present invention arranged between the top and the doffer.

Spinning Test, Example 1

Spinning conditions:

| | |
|---|---|
| Spinning count | Cotton 40's |
| Spinning grains | 380 g/6 yds. |
| R.P.M. of cylinder | 300 r.p.m. |
| R.P.M. of doffer | 24 r.p.m. |

As shown in FIG. 3, as compared with the case without stationary flats, the case with stationary flats showed superior spinning, namely, improved fiber openability, reduced number of neps in the sliver and improved sliver U%.

Spinning Test, Example 2

Spinning conditions:

Spinning count Cotton 30's

| | |
|---|---|
| Spinning count | Cotton 30's |
| Spinning grains | 400 g/6 yds. |
| R.P.M. of cylinder | 310 r.p.m. |
| R.P.M. of doffer | 19 r.p.m. |

Figure 9:
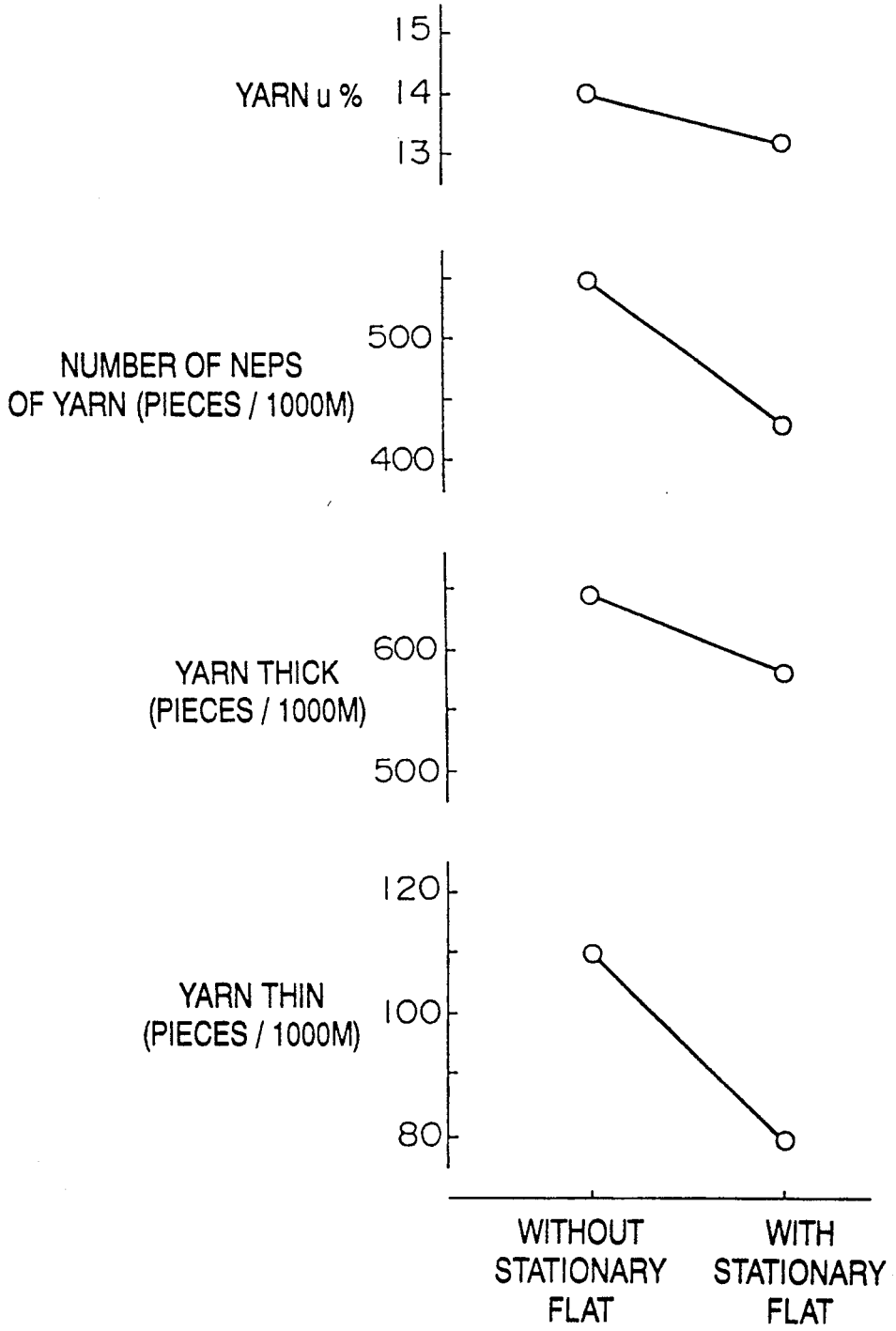

As shown in FIG. 9, as compared with the case without stationary flats, the case with stationary flats showed spinning of yarn of fine quality, namely, improved fiber openability, reduced number of neps in the yarn and improved U% of yarn.

I claim:

1. A stationary flat unit for a carding engine, comprising:

a stationary flat having two base members spaced laterally from each other and each having a radius of curvature corresponding to a front concentric bend of the carding engine, a plurality of stud bolts on each of said base members and spaced at regular intervals therealong in the direction of curvature thereof, a plurality of top bars positioned in parallel and extending between said two base members, each top bar having an inverted L-shape bracket at each end with an arm extending outwardly from a top portion of the top bar, a card clothing on an under surface of said top bars, said arms of said brackets being positioned on corresponding stud bolts on said base members for free movement up and down along said stud bolts, and nuts threaded on said stud bolts and engagable with said bracket arms and tightenable thereagainst for fixing said top bars in an adjusted position on said flat; and an arm on each end of said flat for mounting said flat unit on the carding engine for pivoting movement toward and away from the cylinder of the carding engine.

2. A stationary flat as claimed in claim 1 further comprising laterally extending frame members connected to said base members for forming a base frame having a central opening in which said top bars are positioned.

3. A stationary flat as claimed in claim 1 further comprising a handle on a part of at least one of said arms.

4. A carding engine having a doffer bend, a front concentric bend, a cylinder, and a drum in said cylinder, and at least one stationary flat unit comprising:

a stationary flat having two base members spaced laterally from each other and each having a radius of curvature corresponding to the front concentric bend of the carding engine, a plurality of stud bolts on each of said base members and spaced at regular intervals therealong in the direction of curvature thereof, a plurality of top bars positioned in parallel and extending between said two base members, each top bar having an inverted L-shape bracket at each end with an arm extending outwardly from a top portion of the top bar, a card clothing on an under surface of said top bars, said arms of said brackets being positioned on corresponding stud bolts on said base members for free movement up and down along said stud bolts, and nuts threaded on said stud bolts and engagable with said bracket arms and tightenable thereagainst for fixing said top bars in an adjusted position on said flat; and an arm on each end of said flat pivotally mounted on said doffer bend for mounting said flat unit on the carding engine for pivoting movement toward and away from the cylinder of the carding engine and bringing the card clothing of said flat unit close to card clothing on said drum.

5. A carding engine as claimed in claim 4 further comprising laterally extending frame members connected to said base members for forming a base frame having a central opening in which said top bars are positioned.

6. A carding engine as claimed in claim 4 further comprising a handle on a part of at least one of said arms.

* * * * *